US005283388A

United States Patent [19]

Shimada

[11] Patent Number: 5,283,388

[45] Date of Patent: Feb. 1, 1994

[54] AUTO-PLAY MUSICAL INSTRUMENT WITH AN OCTAVE SHIFTER FOR EDITING PHRASE TONES

[75] Inventor: Yoshihisa Shimada, Hamamatsu, Japan

[73] Assignee: Kabushiki Kaisha Kawai Gakki Seisakusho, Shizuoka, Japan

[21] Appl. No.: 933,203

[22] Filed: Aug. 21, 1992

[30] Foreign Application Priority Data

Aug. 23, 1991 [JP] Japan ..... 3-237143
Aug. 23, 1991 [JP] Japan ..... 3-237144

[51] Int. Cl.[5] ..... G10H 1/00; G10H 7/00
[52] U.S. Cl. ..... 84/609; 84/626
[58] Field of Search ..... 84/609-614, 84/626, 634-638

[56] References Cited

U.S. PATENT DOCUMENTS 4,646,609 3/1987 Teruo et al. ..... 84/609 X
4,991,484 2/1991 Kawashima ..... 84/636 X

*Primary Examiner*—Stanley J. Witkowski

[57] ABSTRACT

An auto-play apparatus for an electronic musical instrument having a plurality of auto-play phrase data stored in memory and accessible through corresponding keys. Note data corresponding to the auto-play phrase data being stored in a separate memory. The apparatus includes an editing function for collectively shifting the pitch of note data constituting a auto-play phrase up or down an octave for easy editing. A shift limit feature prevents the pitch shift function when the result would exceed a preset upper or lower limit.

6 Claims, 12 Drawing Sheets

AUTO-PLAY MUSICAL INSTRUMENT WITH AN OCTAVE SHIFTER FOR EDITING PHRASE TONES

BACKGROUND OF THE INVENTION

1. Field of the Invention

The present invention relates to an auto-play apparatus for an electronic musical instrument for performing an ad-lib phrase play or a fixed phrase play of, e.g., an introduction phrase, a fill-in phrase, an ending phrase, and the like using programmed auto-play note data.

2. Description of the Related Art

An electronic keyboard (e.g., an electronic piano) normally has auto-accompaniment functions including a rhythm auto-accompaniment function, a chord or bass auto-accompaniment function, and the like. Rhythm accompaniment patterns include repetitive patterns (about two bars) such as a waltz pattern or a tango pattern, and single-phrase patterns such as an introduction phrase, a fill-in phrase or an ending phrase, which are properly inserted at desired points of a play. Another electronic musical instrument has a function (a so-called one-finger ad-lib play function) in which different phrases for about one bar are assigned to a plurality of keys, and are selectively read out in response to one-finger key operations so as to obtain an ad-lib play effect by coupling a series of phrases.

These phrase patterns are written in a ROM in advance, and can also be formed and edited by a user himself or herself.

When a user wants to edit an auto-play phrase pattern, he or she repetitively edits the pattern little by little while listening to playback tones of the editing phrase, and then determines a final pattern. The user often forms a user pattern based on phrase data written in the ROM.

When the pitches of notes constituting a phrase are shifted by about one octave during an edit operation of a user pattern, it is convenient to develop the phrase and to obtain good balance between adjacent phrases. In this case, a user must rewrite all the notes to attain the octave shift operation. Therefore, the user must determine the pitches of the notes constituting the phrase, and must have knowledge about music. When the shifted notes are restored to have original pitches, the user must rewrite all the notes again, resulting in a cumbersome edit operation.

SUMMARY OF THE INVENTION

The present invention has been made in consideration of the above situation, and has as its object to provide an auto-play apparatus, which can edit a phrase with a simple operation.

As shown in FIG. 1, an auto-play apparatus of the present invention comprises memory means (a play pattern memory (13) and an auto-play data memory (14) for storing a plurality of phrase tone data, each of which consists of a plurality of note data, and can be selectively read out in response to an operation of a key or an operation button, and tone generator means (15) for forming tone generation signals corresponding to notes constituting phrase tone data from digital waveform information on the basis of the phrase tone data read out from the memory means in response to the operation of the key or operation button. The apparatus is provided with edit means (tone controller (12)) for designating and reading out one of the plurality of phrase tone data from the memory means, and executing an edit operation for modifying note data constituting the readout phrase tone data by key operations, pitch shift means (12*a*) for increasing/decreasing the pitch of each note data being edited by one octave in response to an operation of shift operation means (key K2), and edited phrase tone data memory means (RAM 9) for storing the edited note data.

The pitch of each phrase tone being edited can be easily increased/decreased by one octave without determining the pitch values of notes constituting a phrase or rewriting pitches note by note manually in a try-and-error manner.

DETAILED DESCRIPTION OF THE PREFERRED EMBODIMENTS

Figure 1:
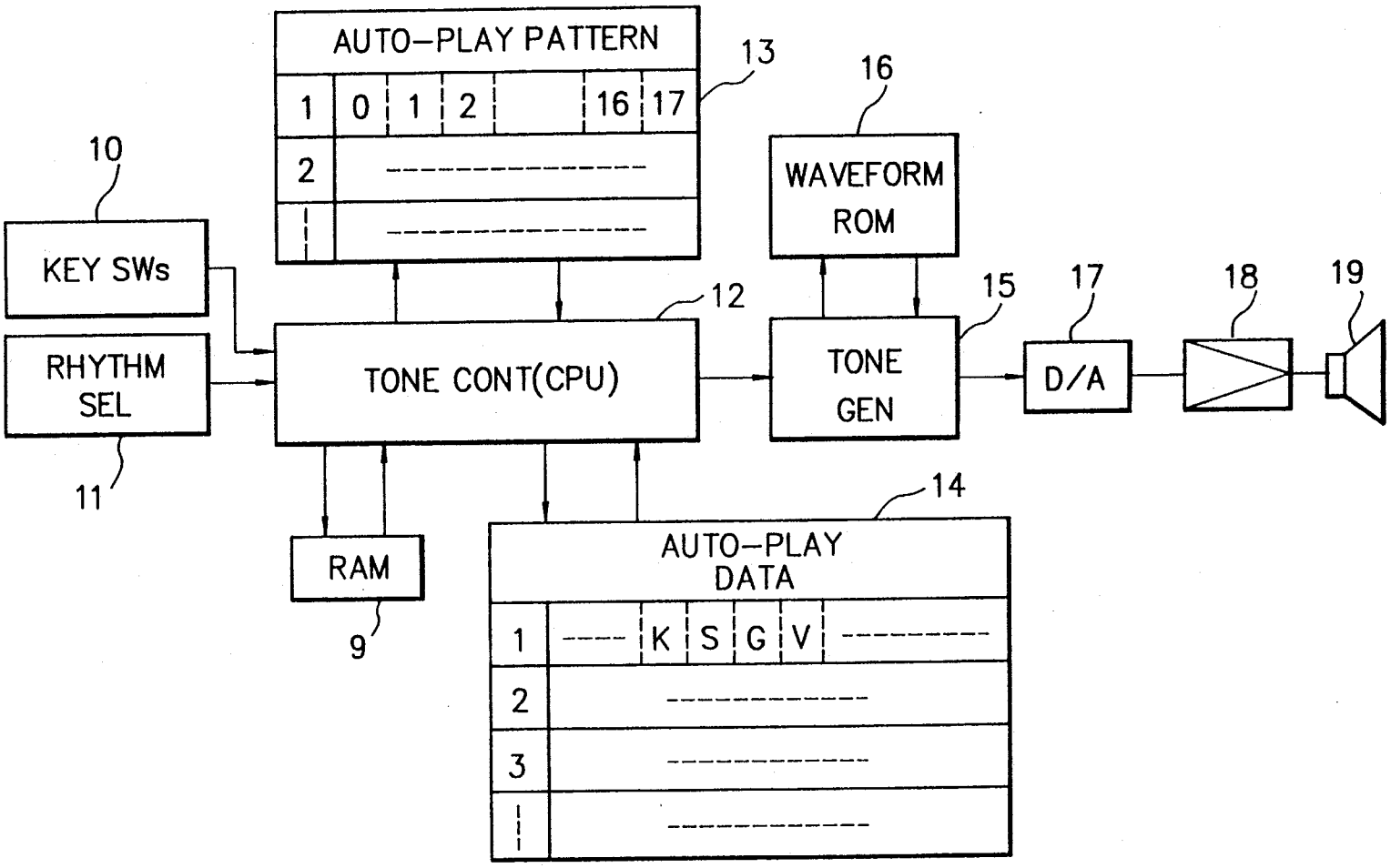
FIG. 1 is a block diagram of an electronic musical instrument according to an embodiment of an auto-play apparatus of the present invention.

FIG. 1 is a block diagram showing the principal part of an electronic musical instrument according to an embodiment of the present invention. This electronic musical instrument comprises a keyboard (not shown). Operation information of the keyboard is detected by a key switch circuit 10 (SWs), and is supplied to a tone controller 12 comprising a CPU. The tone controller 12 outputs, to a tone generator 15, tone generation information on the basis of the key information of the keyboard operation, and auto-accompaniment information written in an auto-play data memory 14 comprising a ROM. The tone generator 15 reads out waveform data corresponding to notes to be generated, modulates the envelope or amplitude of the readout waveform data on the basis of the tone generation information, and generates tone signals. The generated tone signals are supplied to a loudspeaker 19 through a D/A converter 17 and an amplifier 18, thus forming play tones.

An auto-play pattern memory 13 comprising a ROM stores rhythm play patterns (drum, bass patterns, and the like), chord accompaniment patterns, phrase patterns assigned to 17 keys, and single-phrase patterns F0, F1, F2, . . . such as an introduction phrase, a fill-in phrase, an ending phrase, and the like assigned to selection buttons on the panel in units of rhythm types R1, R2, . . . The rhythm can be selected by a rhythm selection unit 11 consisting of rhythm selection buttons on the panel.

Each play pattern consists of address data for reading out a note data string having a length corresponding to about one to four bars from the auto-play data memory 14, and control codes for controlling repetitions of an auto play. Each phrase pattern consists of address data for reading out 17 different note data strings assigned to 17 keys, or note data strings of single phrases such as an introduction phrase, a fill-in phrase, and the like from the auto-play data memory 14, and control codes.

Each note of the note data string stored in the auto-play data memory 14 consists of four bytes, i.e., a key number K (pitch), a step time S (tone generation timing), a gate time G (tone generation duration), and a velocity V (tone generation strength).

In a phrase play mode, phrase data is read out from the auto-play pattern memory 13 in correspondence with an operation of the specific 17 keys on the keyboard or the selection buttons on the operation panel, and note data constituting a phrase of four to eight beats are read out from the auto-play data memory 14 on the basis of the readout phrase data. Since all the phrases corresponding to the 17 keys are different from each other, when the keys are operated at, e.g., every 4-beat timing, an ad-lib play can be easily performed.

When a phrase such as an introduction phrase, a fill-in phrase, an ending phrase, or the like is read out and played back at the beginning, middle, or end of a play, the play can be accentuated.

Figure 2:
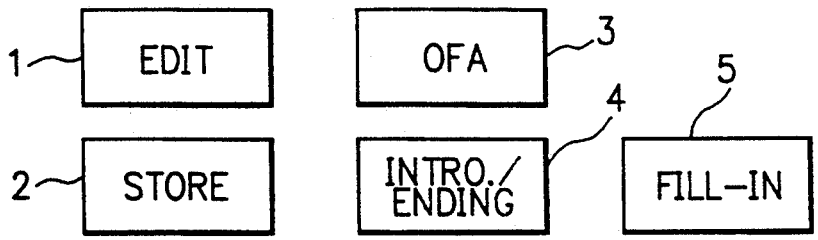
FIG. 2 is a button arrangement chart showing the principal part of an operation panel of the electronic musical instrument of this embodiment.

FIG. 2 shows some of selection buttons on the operation panel. In an ad-lib play mode, when a one-finger ad-lib play (OFA) button 3 is depressed, the specific 17 keys on the keyboard are assigned to ad-lib phrases. An introduction/ending phrase can be alternately selected by a button 4. A fill-in phrase can be inserted during a play by a fill-in button 5.

When an edit button 1 is depressed, play data of these phrases can be desirably modified. The edited data can be stored in a user area of a RAM by depressing a store button 2.

Figure 3:
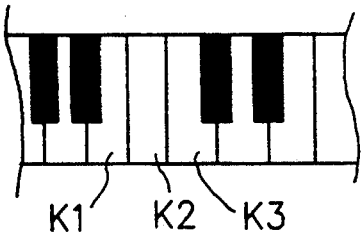
FIG. 3 is a view showing the principal part of a keyboard of the electronic musical instrument of this embodiment.

In an edit mode, specific keys K1 to K3 on the keyboard are assigned to function selection switches, as shown in FIG. 3. The key K1 serves as a phrase clear key, the key K2 serves as an octave shift key, and the key K3 serves as a point select key.

Figure 4:
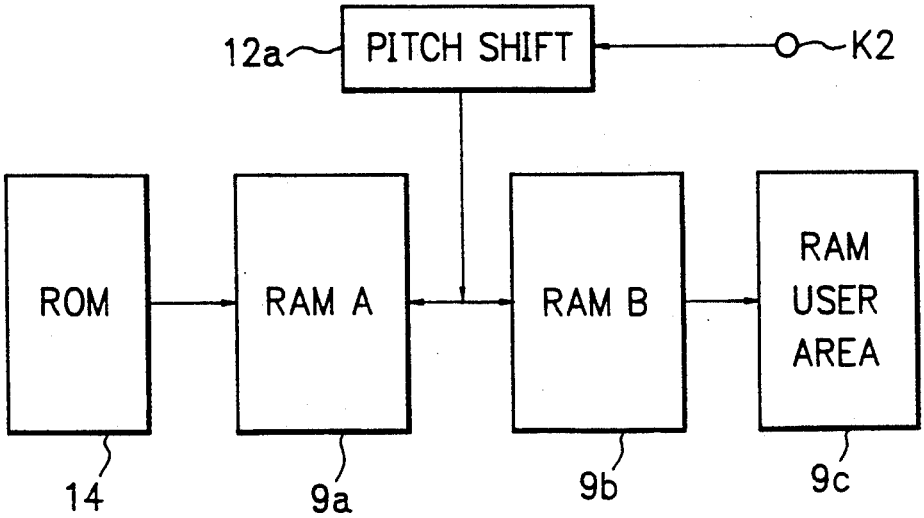
FIG. 4 is a block diagram showing RAM areas used in a phrase edit operation.

FIG. 4 is a diagram showing a memory operation in the edit mode. Note data for one phrase selected and read out from the auto-play data memory 14, a ROM, are written in a work area A (*9a*) of a RAM 9, and an edit operation is performed using the area A and an area B (*9b*). The edited note data are written in a user area *9c* of the RAM 9.

Figure 5:
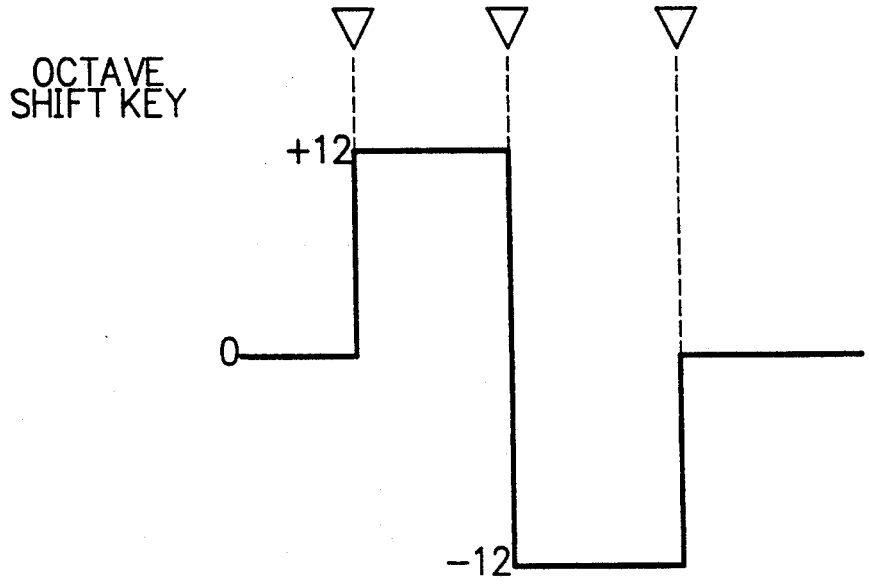
FIG. 5 is a view for explaining an octave shift operation of a phrase tone.

FIG. 5 shows a pitch shift state obtained when the key K2 as the octave shift key (K2) is depressed in the edit mode. Once the octave shift key (K2) is depressed, all the notes of the note data written in, e.g., the area A of the RAM 9 are shifted by one octave (+12 pitches) by a pitch shift means 12*a* (CPU) shown in FIG. 4 in an increase direction, and the shifted data are written in the area B of the RAM 9. When the octave shift key (K2) is depressed again, the note data written in the area B are shifted by two octaves (−12 pitches from original note data) in a decrease direction, and the shifted data are written in the area A. When the octave shift key (K2) is depressed once more, the note data written in the area A of the RAM are written in the area B with a pitch shift by one octave to restore the original pitches. In this manner, since the phrase data can be modified as needed while shifting their pitches by one octave in the increase/decrease direction, a phrase edit operation can be quickly attained.

When the keys K1 to K3 must be used for tones in a phrase to be edited, the edit operation may be performed using keys different by one octave, and the edited data can be shifted by one octave after the edit operation.

The data processing sequence of the tone controller 12 (CPU) in the edit mode will be described below with reference to the flow charts shown in FIGS. 6 to 13.

Figure 6:
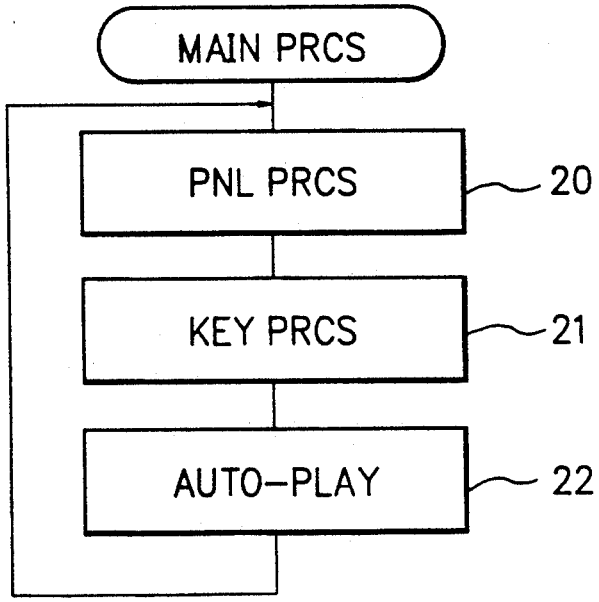
FIGS. 6 to 13 are flow charts showing a data processing sequence of the electronic musical instrument.

FIG. 6 shows a main flow of the CPU. In step 20, operation detection processing of the operation panel is performed. In step 21, key operation detection processing is performed. In step 22, auto-play processing is performed.

Figure 7:
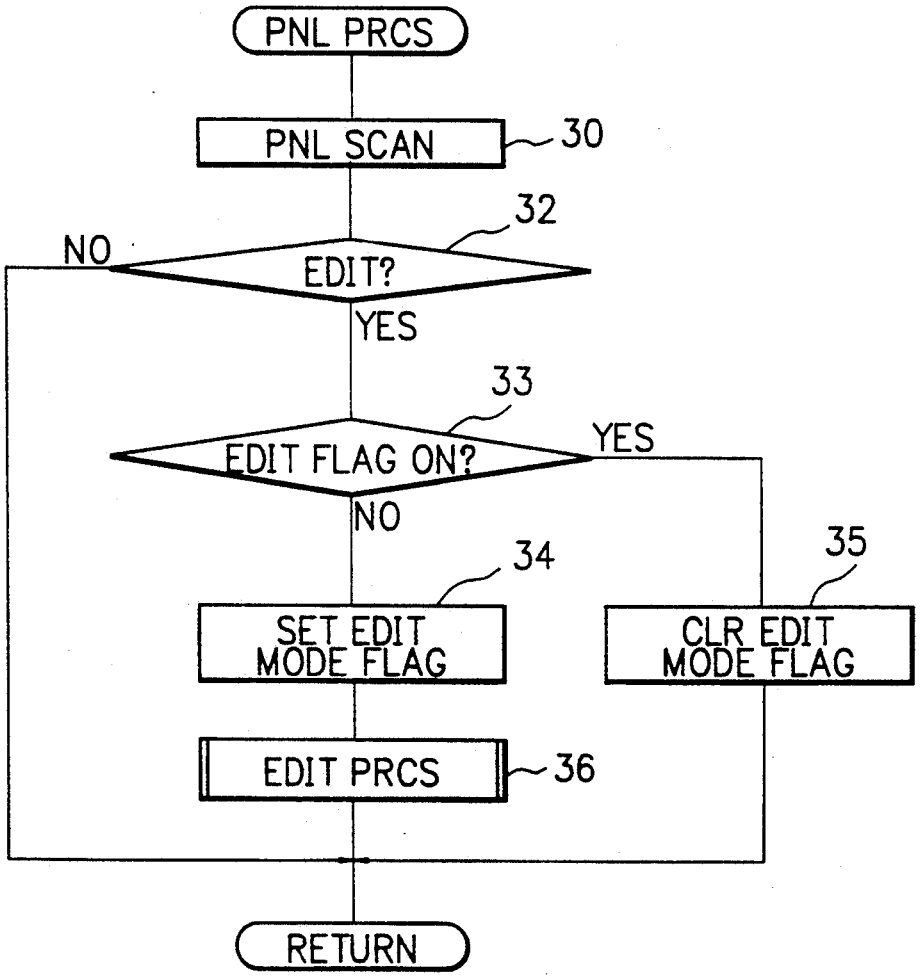

FIG. 7 shows a flow of panel processing. In step 30, scan detection of the panel buttons is performed. It is then checked in step 32 if the edit button is depressed. If YES in step 32, it is checked in step 33 if an edit flag is ON. If NO in step 33, the edit flag is set in step 34, and the flow then advances to step 36 to execute edit processing. However, if YES in step 33, the edit flag is cleared in step 35.

Figure 8:
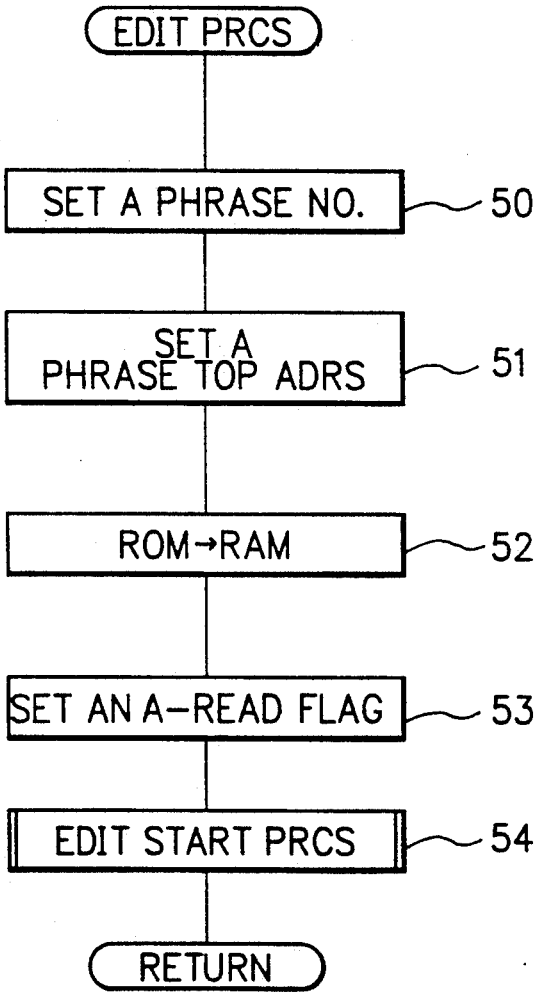

FIG. 8 shows a flow of the edit processing. In step 50, a phrase number is set in a register. The phrase number is selected by depressing the point select key (K3) set on the keyboard (FIG. 3), and then depressing the key assigned to a given ad-lib phrase or the panel button assigned to an introduction, fill-in, or ending phrase so as to designate a phrase to be edited.

In step 51, play pattern data corresponding to the phrase number is read out from the auto-play pattern memory 13, and the top address of a note data string stored in the auto-play data memory 14 is set in a register. Then, the phrase note data are transferred from the auto-play data memory 14 (ROM) to the area A of the RAM 9 in step 52. In step 53, a read flag of the area A of the RAM 9 is set, and the flow then advances to step 54 to execute edit start processing.

Figure 9:
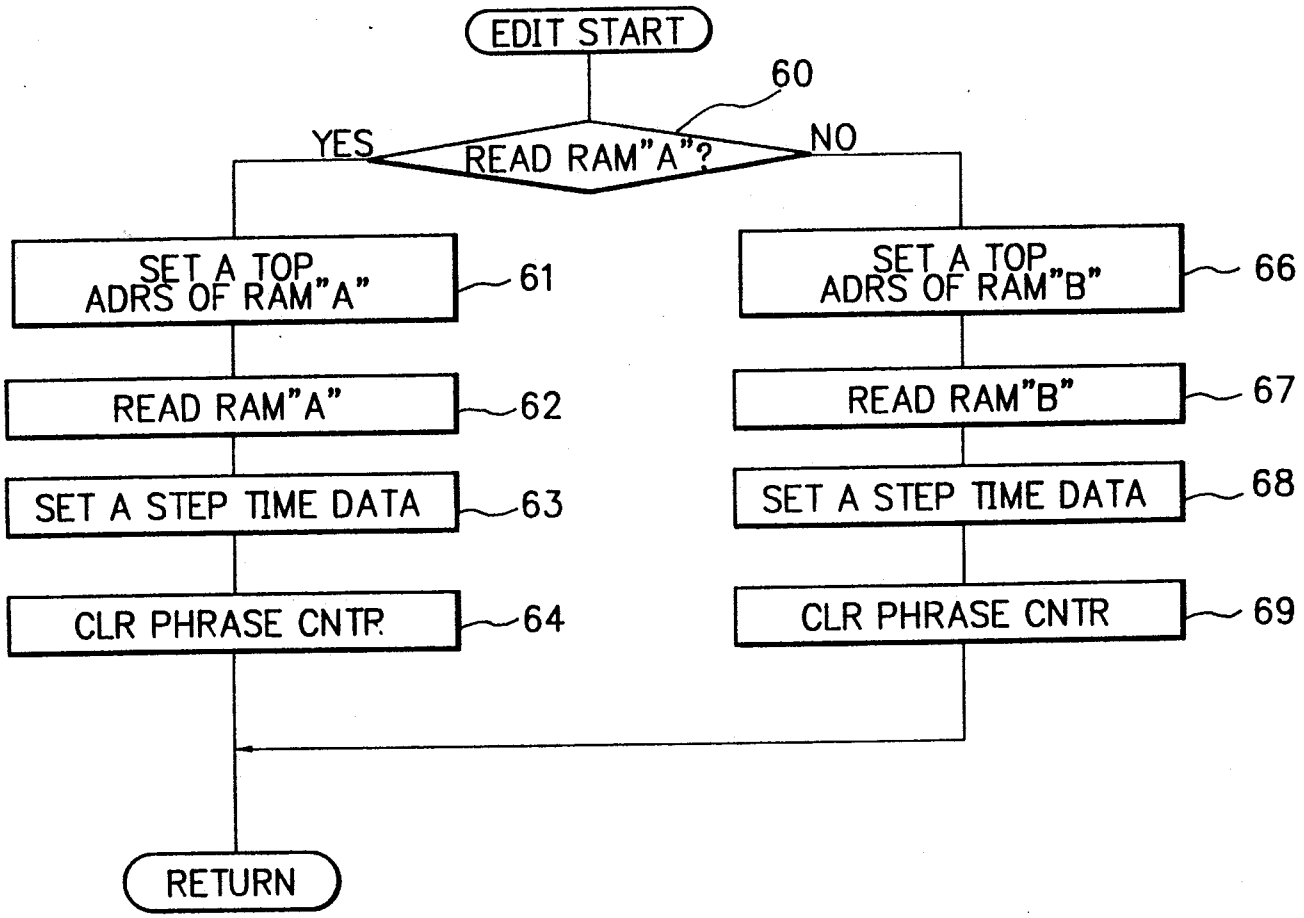

FIG. 9 shows the edit start processing. In step 60, it is checked if the phrase note data is transferred to the area A or B of the RAM. If it is determined that the phrase data is transferred to the area A, the top address of the area A is set in step 61 so as to read out the phrase note data from the area A of the RAM. In step 62, the phrase note data is read out from the RAM, and in step 63, first step time data (tone generation timing) is set. In step 64, a phrase counter for measuring a time base at a rate of a quarternote=24 clocks is cleared.

If it is determined in step 60 in FIG. 9 that the phrase data is set in the area B of the RAM, the flow advances to step 66, and the top address of the area B is set. Thereafter, in steps 67, 68, and 69, the phrase data is read out from the area B, step time data is set, and the phrase counter is cleared. Thereafter, this processing returns to the main routine.

Figure 10:
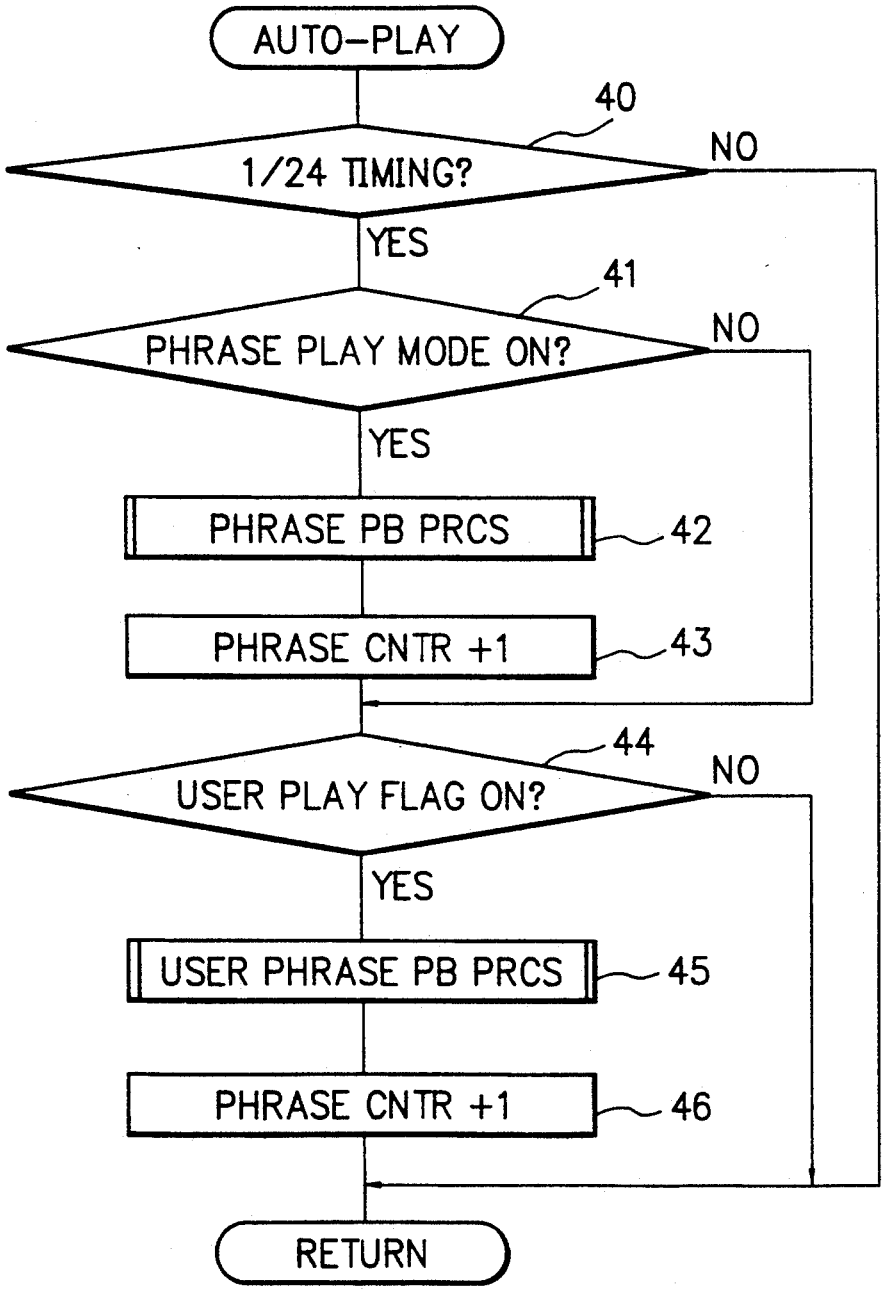

FIG. 10 shows the auto-play processing in the main routine. If a timing 1/24 a quarternote is detected in step 40, it is checked in step 41 if a phrase play mode flag is ON. If YES in step 41, phrase playback (PB) processing is performed in step 42. Upon completion of this processing, the content of the phrase counter is incremented by 1 in step 43.

If it is determined in step 41 that the phrase play mode flag is OFF, the flow jumps from step 41 to step 44 to check if a user play flag for playing back a user-edited phrase is ON. If YES in step 44, user phrase PB processing is performed in step 45. Upon completion of this processing, the content of the phrase counter is incremented by 1 in step 46, and the flow returns to the main routine.

Figure 11:
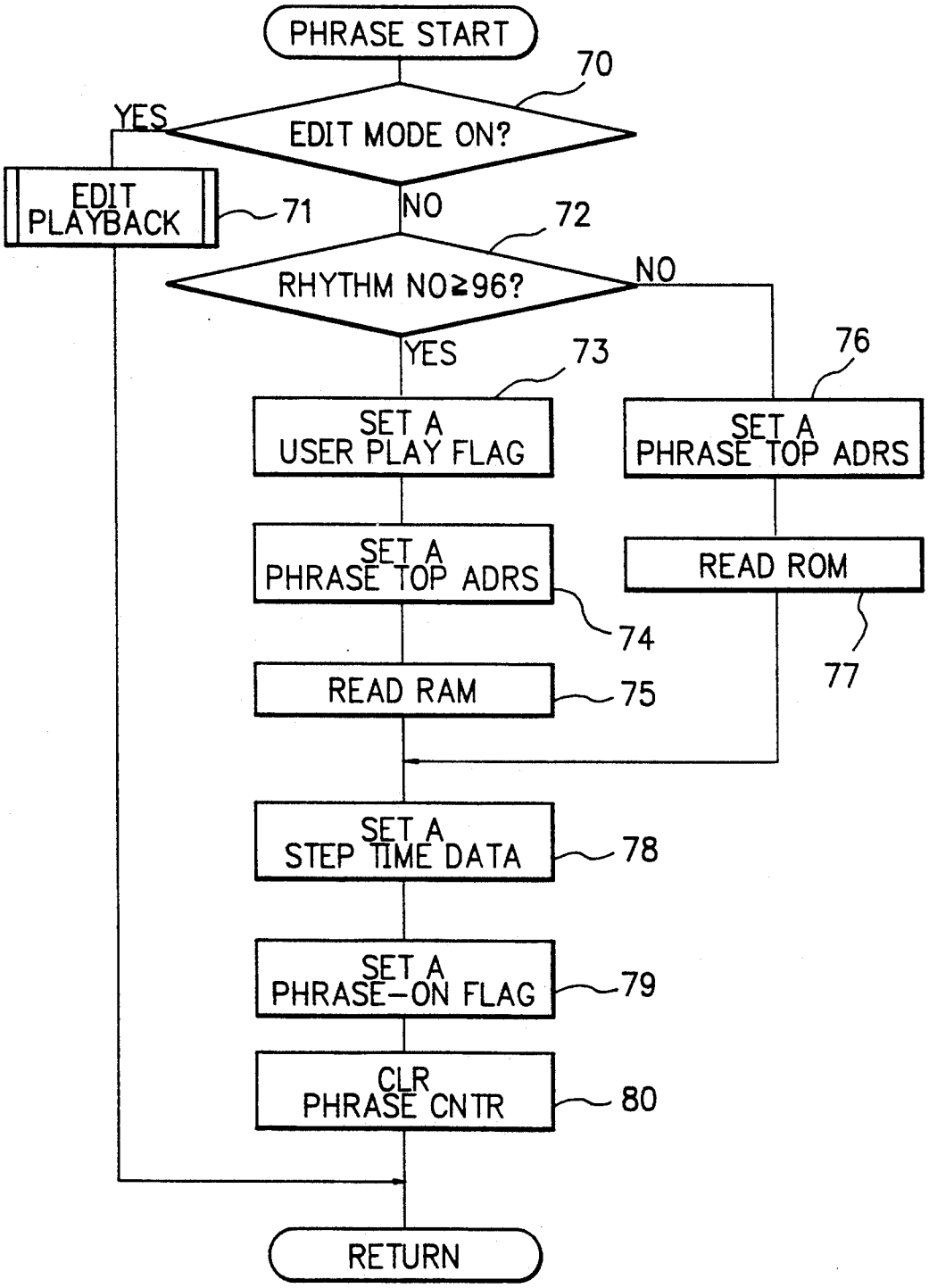

FIG. 11 shows phrase start processing executed at the beginning of the phrase PB processing in step 42 or the user phrase PB processing in step 45 in FIG. 10. In step 70, it is checked if the edit mode flag is ON. If YES in step 70, edit playback processing is performed in step 71. If NO in step 70, it is checked in step 72 if a rhythm number is equal to or larger than 96. A rhythm number equal to or larger than 96 indicates phrase data edited by a user. When phrase data written in the user area of the RAM 9 is selected, one of 96 to 100 is selected as the rhythm number.

If NO in step 72, the top address of a phrase selected by the key operation or the panel button operation is read out from the auto-play pattern data memory 13 and is set in step 76. In step 77, a note data string of the phrase is read out from the auto-play data memory 14 (ROM). In step 78, step time data of the first note is set. In step 79, a phrase ON flag is set. In step 80, the phrase counter is cleared. Thereafter, when the phrase counter reaches the step time, tone generation processing is performed. The ROM address is then advanced by four bytes to read out the next note data. When the step time of the readout data is reached, tone generation processing is performed. This operation is repeated.

Figure 12:
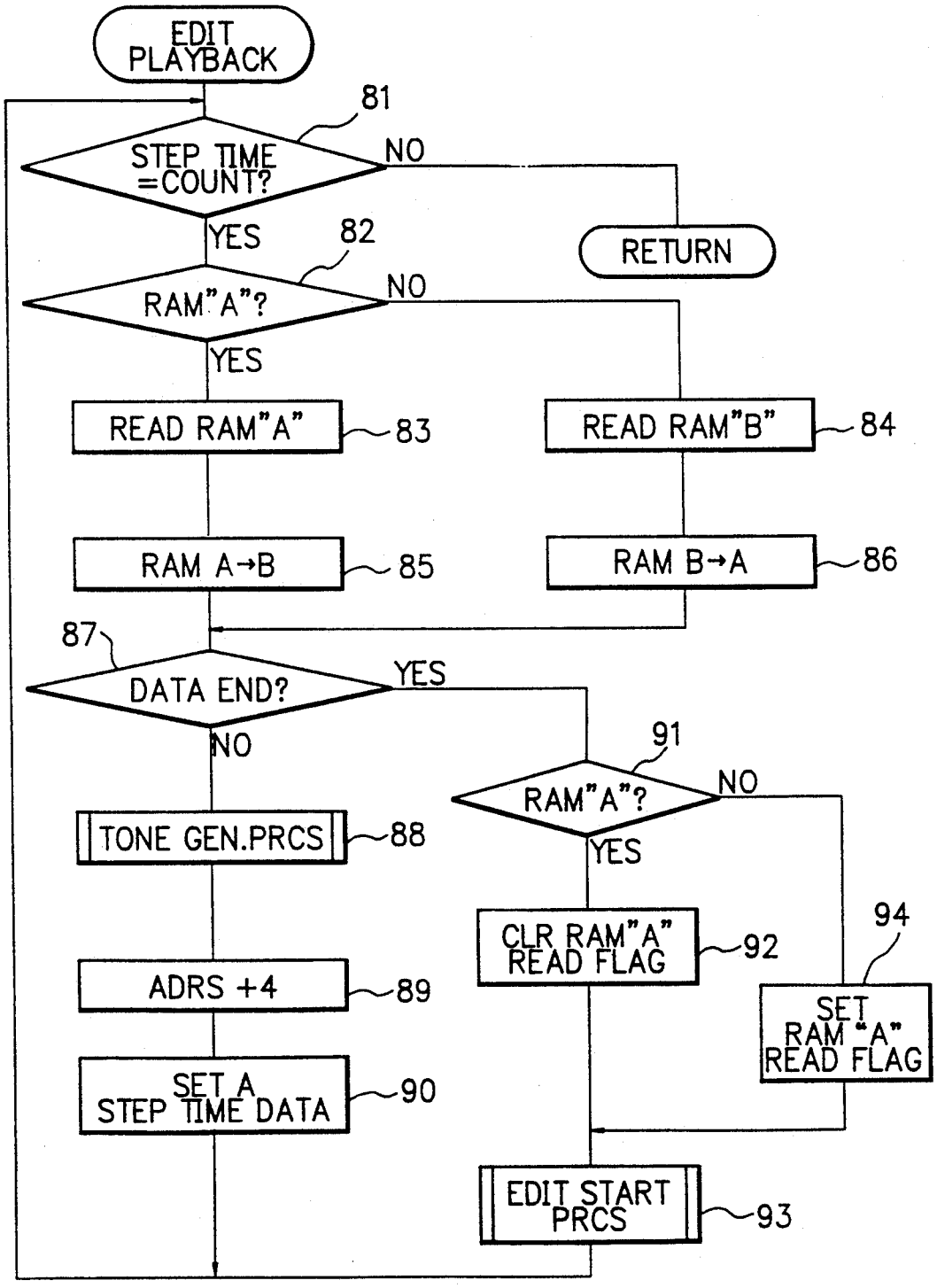

FIG. 12 shows the edit playback processing in the edit mode. In the edit mode, as has been described above with reference to FIG. 9, the step time data of the first note of the user phrase data in the area A or B of the RAM 9 is set in the register in the edit start routine. In FIG. 12, if it is detected in step 81 that the count value has reached the step time, it is then checked in step 82 if the read flag of the area A of the RAM is ON. If YES in step 82, 4-byte note data per note is read out from the area A in step 83, and the readout note data is transferred from the area A to the area B of the RAM in step 85. If it is determined in step 82 that the read flag of the area A is OFF, 4-byte note data per note is read out from the area B in step 84, and the readout note data is transferred from the area B to the area A of the RAM in step 86.

It is checked in step 87 if the readout note data is a data end of a series of phrase data. If NO in step 87, tone generation processing is performed based on the readout note data in step 88. Upon completion of tone generation of one tone, the address is advanced by four bytes in step 89. In step 90, step time data of the next note is set. Thereafter, the flow returns to step 81, and the above-mentioned processing is repeated to generate phrase tones.

If it is determined in step 87 that the note data indicates the end of the phrase, the flow branches to step 91 to check if the read access to the area A of the RAM is made. If YES in step 91, the read flag of the area A is cleared in step 92 to prepare for the next read access to the area B; otherwise, the read flag of the area A is set in step 94. Upon completion of the flag processing, the flow then advances to step 93 to execute edit start processing.

Phrase data is edited by inputting data of another note from the keyboard by utilizing data transfer of phrase data between the areas A and B upon generation of the phrase tones, and storing the input data in the transfer destination.

Figure 13:
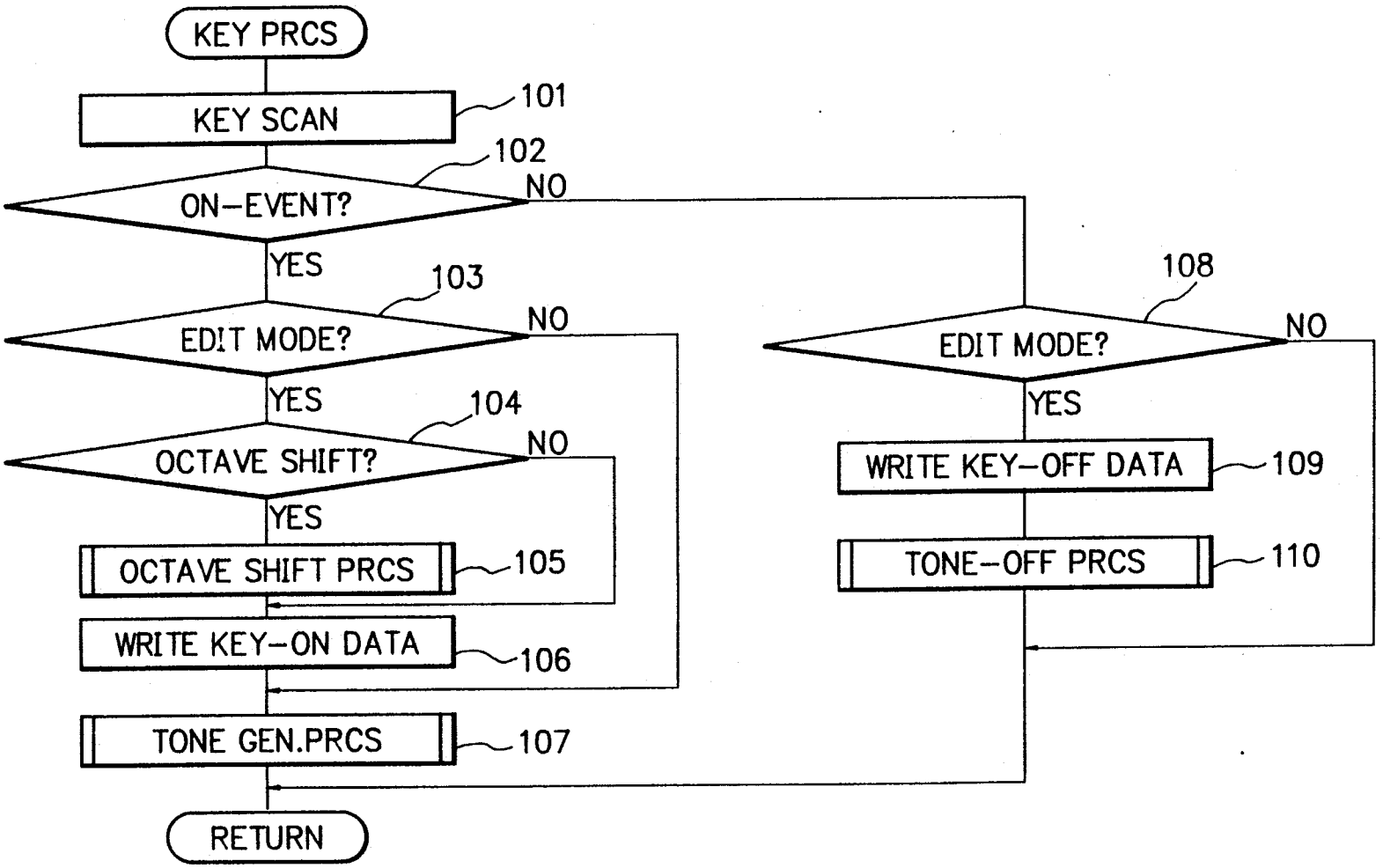

FIG. 13 shows key processing in the edit mode. In step 101, operation detection of the keys is performed by key scan. In step 102, it is checked if an ON-event (key depression) or an OFF-event (key release) is detected. If it is determined in step 102 that an ON-event is detected, the edit mode flag is checked in step 103. If it is determined in step 103 that the edit mode flag is OFF, tone generation processing corresponding to the ON-event is performed in step 107. If it is determined in step 103 that the edit mode flag is ON, it is checked in step 104 if the octave shift key (K2) is depressed. If YES in step 104, octave shift processing for adding 12 to the pitch values of notes of phrase data in the area A or B of the RAM is performed in step 105. As has been described above with reference to FIG. 5, if the second key depression of the octave shift key (K2) is detected, shift processing for subtracting 12 from the pitch values of notes of phrase data is performed. If the third key depression of the octave shift key (K2) is detected, processing for restoring original tone pitches is performed.

If the ON-event is not that of the octave shift key, key-ON data (key number, step time, gate time, velocity) is inserted in original phrase data in the RAM area (A or B) of the transfer destination in step 106. In step 107, tone generation processing corresponding to the ON key is performed.

If an OFF-event is detected in step 102, the edit mode flag is checked in step 108. If it is determined in step 108 that the edit mode flag is ON, key-OFF data is inserted in the phrase data in the RAM in step 109, and tone-OFF processing is performed in step 110. Thereafter, the flow returns to the main routine.

In this manner, the pitches of phrase tones can be increased/decreased by one octave by using the octave shift key (K2), and the octave-shifted phrase data can be edited, thus allowing a very easy edit operation.

When octave-shifted phrase data is shifted by another octave in the same direction, the phrase data is temporarily stored in the user area using the store button (FIG. 2). Then, the point select key (key K3) is depressed to read out the target phrase data from the user area. When the readout phrase data is re-edited, the above-mentioned octave shift operation is performed.

Upon completion of the edit operation, the store button (FIG. 2) is depressed. As shown in FIG. 4, the edited user phrase data written in the RAM area A or B is transferred to the user area 9c (assigned with rhythm numbers 96 to 100 as described above) of the RAM 9, and is registered as a user phrase.

In the above embodiment, a key is commonly used as the octave shift key. However, a special-purpose shift operation button may be arranged on the operation panel. In the above embodiment, the octave shift key serves as both octave shift-up and shift-down keys. However, these keys or buttons may be separately arranged.

As described above, when auto-play data of a phrase is edited, the pitches of phrase notes can be increased/decreased by one octave upon operation of a button or a key. Thus, an edit operation for developing a registered phrase can be easily performed. When a phrase being edited is shifted by one octave, the pitch values of the original phrase notes need not be determined, and pitch conversion need not be performed note by note manually in a try-and-error manner. Thus, a user who has no knowledge about music can form desired phrase data within a short period of time.

Figure 14:
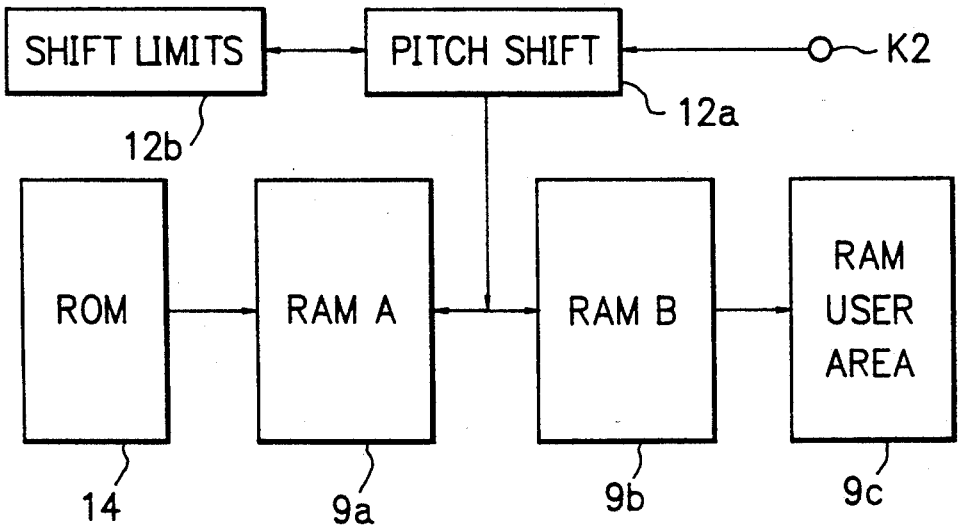
FIG. 14 is a block diagram similar to FIG. 4 showing an arrangement added with the shift limit processing means.

FIG. 14 shows a modification of the present invention. In this modification, a shift limit processing means 12*b* is added to the blocks shown in FIG. 4. When the octave shift operation is repeated in the same direction, note data may often become insignificant data (invalid data) or data consisting of notes which cannot establish a phrase. Thus, as shown in FIG. 14, the shift limit processing means 12*b* is added to the pitch shift means 12*a*. When shifted note data exceeds a predetermined upper or lower limit, the note data is restored to that before the shift operation so as not to cause trouble in the edit operation.

The shift limit processing means 12*b* is constituted by a CPU and its program, and holds C6 as an upper limit value, and C1 as a lower limit value in advance. These upper and lower limit values may be pre-programmed or may be desirably set by a user.

When note data is shifted by one octave by the pitch shift means 12*a*, the shift limit processing means 12*b* checks the pitch of each note. When the pitch of the note data exceeds the upper or lower limit value, the shift limit processing means 12*b* restores the note data to that before the shift operation, and transfers it to the area A or B of the RAM 9.

Figure 15:
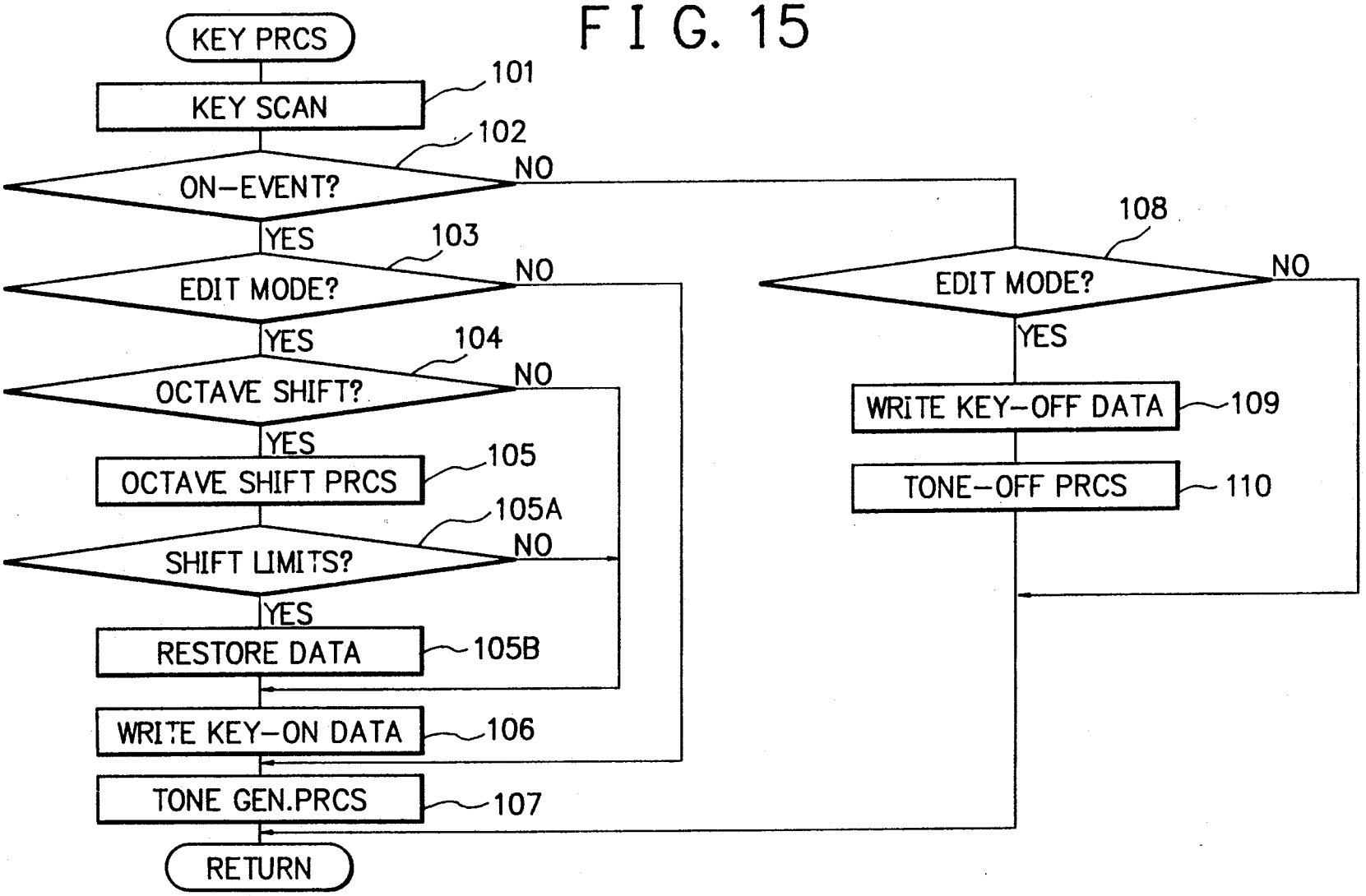
FIG. 15 is a flow chart showing a key processing routine in the modification shown in FIG. 14.

FIG. 15 is a flow chart showing key processing routine when the shift limit processing in FIG. 14 is added. The same reference numerals in FIG. 15 denote the same steps as in FIG. 13. In step 105A, it is checked if the pitch of the octave-shift result in step 105 exceeds the shift limit (upper or lower limit). If NO in step 105A, the flow advances to step 106; otherwise, processing for restoring note data to a state before the shift processing is performed in step 105B. Thereafter, the flow advances to step 106.

With this processing, note data as a result of the octave shift processing can be prevented from becoming insignificant invalid data or data which cannot establish a phrase.

What is claimed is:

1. An auto-play apparatus comprising:

memory means for storing a plurality of phrase tone data each including a plurality of note data;

edit means for designating and reading out one o the plurality of phrase tone data from said memory means, and executing an edit operation on the note data of the designated readout phrase tone data;

said edit means including, pitch shift means for collectively increasing/decreasing a pitch of the readout note data by one octave, and edited phrase tone data memory means for storing the pitch shifted note data; and tone generator means for forming tone generation signals corresponding to the pitch shifted note data read out from said edited phrase tone data memory means.

2. An auto-play apparatus according to claim 1, wherein said pitch shift means includes shift operation means for restoring the pitch shifted note data to its original pitch.

3. An auto-play apparatus according to claim 2, further comprising a keyboard having a plurality of keys wherein said shift operation means is responsive to a specific key of said plurality of keys on said keyboard.

4. An auto-play apparatus according to claim 1, wherein said edit phrase tone data memory means includes, a first read/write memory means for storing the note data of the designated readout phrase tone data, a second read/write memory for storing the pitch shifted note data, and said tone generator means for generating tone generation signals corresponding to note data of the readout phrase tone data and the pitch shifted note data.

5. An auto-play apparatus according to claim 3, wherein a specific key on said keyboard controls operation of said shift operation means wherein the pitch shift means shifts the readout note data by a +1octave responsive to a first depression of said key, a −2octaves pitch shift (−1octave shift to the original) by a second depression of said key, and a +1octave pitch shift by a third depression of said key to restore to the readout note data to its original pitch.

6. An auto-play apparatus according to claim 1, further comprising shift limit processing means for preventing the increase/decrease of a pitch of note data by said pitch shift means from exceeding a predetermined upper or lower limit.

* * * * *